United States Patent [19]

Bagus

[11] 4,205,578

[45] Jun. 3, 1980

[54] ELECTRONIC MUSICAL INSTRUMENT SIGNAL GENERATOR

[75] Inventor: Brian M. Bagus, Bartlett, Ill.

[73] Assignee: Marmon Company, Chicago, Ill.

[21] Appl. No.: 880,735

[22] Filed: Feb. 24, 1978

[51] Int. Cl.[2] ..... G10H 1/02

[52] U.S. Cl. ..... 84/1.24

[58] Field of Search ..... 84/1.11, 1.19, 1.22, 84/1.24, 1.25, DIG.5, 1.01

[56] References Cited

U.S. PATENT DOCUMENTS

| | | | |
|---|---|---|---|
| 2,989,886 | 6/1961 | Markowitz | 84/1.19 |
| 2,989,887 | 6/1961 | Markowitz | 84/1.24 |
| 3,037,413 | 6/1962 | Markowitz | 84/1.24 |
| 3,557,295 | 1/1971 | Adachi | 84/1.19 X |
| 3,571,484 | 3/1971 | Hirose | 84/1.19 |
| 3,617,604 | 11/1971 | Adachi | 84/1.22 |
| 3,711,617 | 1/1973 | Evans | 84/1.01 |
| 3,711,620 | 1/1973 | Kameoka | 84/1.24 |
| 3,775,545 | 11/1973 | Tsukamoto et al. | 84/1.22 X |
| 3,867,862 | 2/1975 | Jones et al. | 84/1.19 |

*Primary Examiner*—S. J. Witkowski

*Attorney, Agent, or Firm*—Neuman, Williams, Anderson & Olson

[57] ABSTRACT

An AC keying transient is simulated in a DC keyed electronic musical instrument by gating a pseudorandom frequency noise source output to the audio output circuit of the instrument during a brief time interval initiated by a legato pulse. The level of the noise is randomly selected from a range of values of a triangular wave form. The amplitude range of the triangular wave form is determined for each keyboard manual by chopping the highest drawbar voltage setting with an approximately 20 percent to 80 percent duty cycle higher frequency rectangular wave pulse gated by a low frequency square wave. The variable duty cycle wave form serves as an amplitude control for all keyboards with an equal effect being provided by the individual drawbar voltage settings for each keyboard. The chopper output is filtered to remove the variable duty cycle pulses leaving the triangular wave form which is integrated from the 6.8 hz square wave signal.

4 Claims, 2 Drawing Figures

NOISE GATE
NOISE CHOPPER
WHITE NOISE
RANDOM AND LEVEL CHOPPER
LOWER MANUAL
AUDIO OUT
LEGATO IN
-14V 0V
(a)
-14V
0
(b)
-V

ELECTRONIC MUSICAL INSTRUMENT SIGNAL GENERATOR

BACKGROUND OF THE INVENTION

1. Field of the Invention

The invention is in the field of signal generators for electronic musical instruments.

2. Description of the Prior Art

In the past there has been a AC keying transient associated with the keying of electronic organs which utilized AC keying such as in tone wheel generator organs. While attempts were made to suppress these transients, they nonetheless became an identifiable element of the musical sounds produced by these organs. So far as applicant is aware, no attempt has heretofore been made to duplicate the audio effect of these keying transients in a DC keyed organ.

SUMMARY OF THE INVENTION

One embodiment of the present invention is a sound generator for an electronic musical instrument comprising first means for generating a first varying signal at an output, second means for generating a second signal at an output, third means, coupled to the output of the first means and the output of the second means and having an output, for coupling to its output the second signal for a time interval significantly shorter than the period of the principal frequency components of the first signal and for setting the amplitude of the coupled signal at its output dependent upon the amplitude of the first signal during said time interval, and an audio output means coupled from the output of the third means for producing audible sound in response thereto.

BRIEF DESCRIPTION OF THE DRAWINGS

FIG. 2(*b*) shows the filtered output of the first chopper of FIG. 1.

DESCRIPTION OF THE PREFERRED EMBODIMENT

Figures 1, 2:
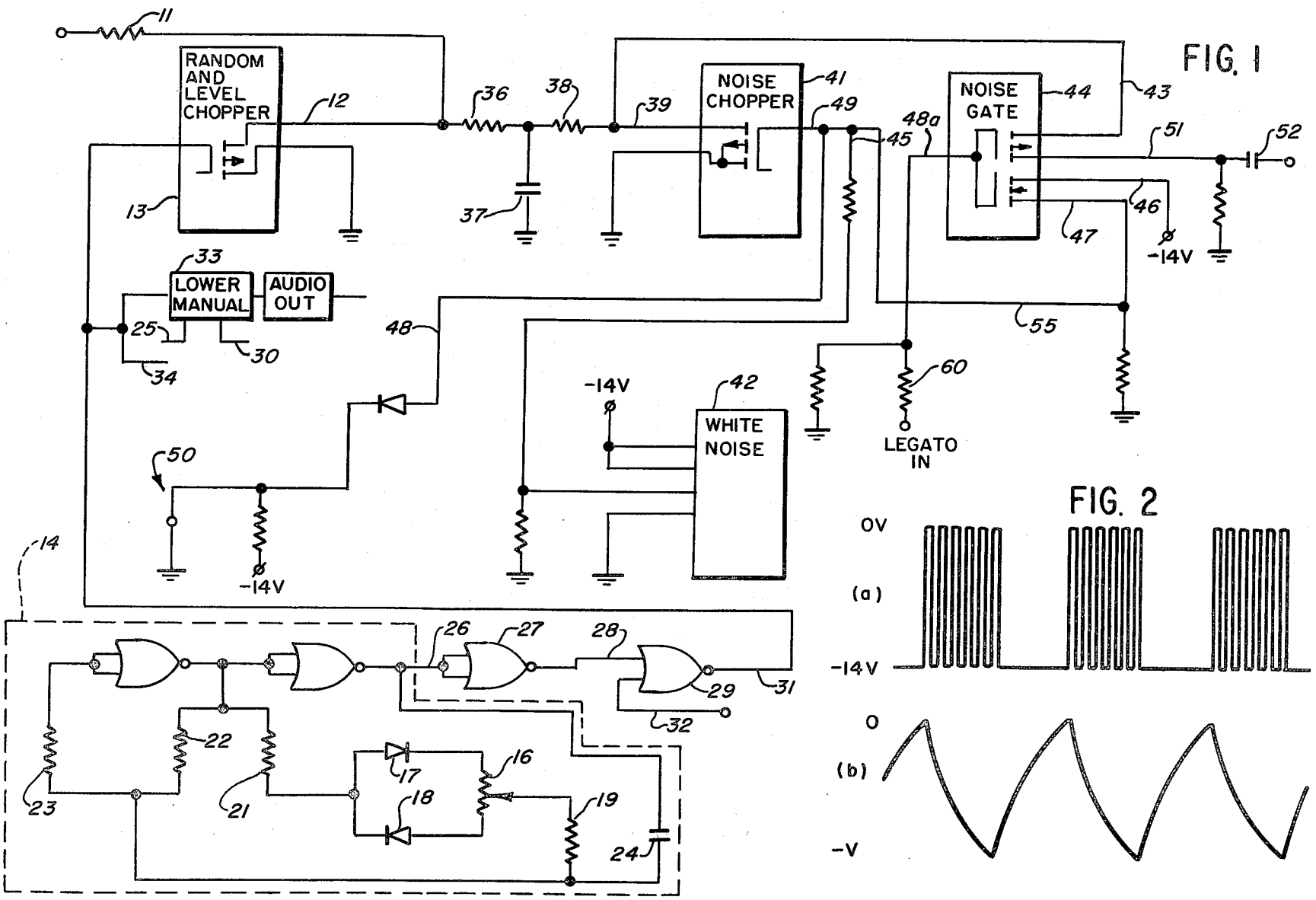
FIG. 1 is a circuit diagram of a circuit for generating a simulated AC keying transient signal according to an embodiment of the present invention.
FIG. 2(*a*) shows the input to the first chopper of FIG. 1.

Referring in particular to FIG. 1, there is shown in detail one channel of a multichannel circuit for generating a simulated AC keying transient for an electronic organ. A second and subsequent channels branching from this system are shown diagrammatically. Only one channel shall be described in detail since the other channels are essentially identical. In practice a separate channel is provided, for example, for each keyboard of the electronic organ.

As shown in FIG. 1, a variable DC voltage, settable in the present exemplary embodiment between zero and a negative 11 volts, is coupled through resistor 11 to input line 12 of a chopper 13. Chopper 13 chops the level signal on line 12 with another signal from line 31 which produces a "randomizing" signal to be utilized as shall be explained hereinafter. The voltage on line 12 corresponds to the highest drawbar voltage for a given keyboard manual of the organ. In the embodiment shown, line 12 is coupled from the upper manual drawbars, the drawbars being, as is well known, the amplitude controls for the various harmonics for the tones for that keyboard.

The chopper is a shunt gate driven by pulse width modulation circuitry to be described hereinafter. This circuitry produces a series of variable duty cycle pulses at a 6.8 hz typical repetition rate. The circuitry within dashed line 14 is a standard oscillator circuit producing an output at a nominal frequency of about 20 Khz. The duty cycle of the output wave form on line 26 is variable by the setting of potentiometer 16. The high-going portion of the wave form on line 26 may be varied in this fashion over a duty cycle range from 20 percent to 80 percent approximately.

Exemplary values for the oscillator components are: potentiometer 16, 50K; resistor 19, 1K; resistor 21, 2.2K; resistor 22, 47K; resistor 23, 100K; and capacitor 24, 1200pf. The oscillator components are preferably of a 2 percent tolerance or better.

The output rectangular wave signal with the variable duty cycle is coupled on line 26 to a buffer-inverter 27 whose output on line 28 is one input to NOR gate 29. The other input to NOR gate 29 on line 32 is a 6.8 hz square wave, and both inputs to NOR gate 29 vary between zero volts (high) and minus 14 volts (low). The resulting output on line 31 is shown in FIG. 2(*a*).

As shown in FIG. 2(*a*), when the 6.8 hz square wave input to NOR gate 29 is high, the rsulting output wave form is low. During the time when the square wave input is low, the variable duty cycle wave form determines the output, with gate 29 acting as an inverter. Due to the two inverting stages 27 and 29, the greater the duty cycle of the high oscillator output on line 26, the greater the duty cycle of the high output on line 31. The actual frequency of the pulses illustrated in FIG. 2(*a*) within each of the three illustrated groupings is much higher than is shown. The duty cycle illustrated is approximately 50 percent.

The variable duty cycle gated output on line 31 is, as indicated above, coupled as a chopping signal to chopper 13. This same signal on line 31 is also coupled to simulated transient wave form generator circuits for other sections of the electronic organ such as the lower manual keyboard. If another keying system were being utilized such as for percussion voicing of one of the manuals with another keying system, and another set of harmonic content controls were associated therewith, the signal on line 31 could be provided for a transient simulation circuit for that manual keyer system as well.

Shown diagramatically in FIG. 1, coupled from line 31, are a lower manual keyboard AC transient simulation circuit 33 having its own drawbar and key-down inputs, 25 and 30 respectively, and also another line 34 running to another possible transient simulation circuit. The essential point is that any number of additional AC transient simulation circuits may be utilized, each with their own separate drawbar voltage input, which affects the transient signal level, but also receiving a transient signal level control from the common line 31. This permits a master volume control for the simulated AC keying transient signal which cooperates with the individual highest drawbar voltage setting for each keyboard manual to jointly determine the keying transient output level.

The output signal on line 31 chops the voltage on line 12 of the chopper 13. The chopped voltage on line 12 is fed through resistor 36 to capacitor 37, which is alternately charged and discharged by chopper 13 through resistor 36. When line 31 is high, the chopper 13 gate is open permitting capacitor 37 to charge. Capacitor 37 charges to a level which is approximately equal to the percentage of the duty cycle of the variable duty cycle wave form multiplied by the level of the input voltage from the upper manual drawbar at the input to resistor 11. For example, if line 12 were coupled from a negative 10 volt drawbar setting and the (nominal) 20 Khz pulses from oscillator 14 were at a 50 percent duty cycle, then capacitor 37 would charge to a peak negative value of 5 volts. This would be the minus V voltage shown in FIG. 2(*b*). FIG. 2(*b*) is a diagramatic representation of the voltage fluctuations on capacitor 37. Capacitor 37 actually discharges to a voltage slightly below zero.

Capacitor 37 charges and discharges at the 6.8 hz rate, and the capacitor is large enough to filter out the higher frequency duty cycle wave form components. This essentially triangular wave on capacitor 37 is coupled through resistor 38 to controlled input 39 of chopper 41. Exemplary values for resistor 36, capacitor 37 and resistor 38 are 22K, 2.2uf and 47K, respectively.

Noise chopper 41 receives a control input on line 49 from enable switch 50. When switch 50 is closed as shown in FIG. 1, the system is enabled by placing line 48 at ground, or a logic high, permitting control of the chopper 41 switch. If master control switch 50 is open, the −14 volt supply voltage is connected on line 48 to control input 49 of chopper 41 grounding line 39 by turning on the switch. This prevents any output signals from proceeding further in the system.

A legato input from the upper manual is coupled through resistor 60 to control line 48*a* of noise gate 44. Line 48*a* is normally high except during the approximately 2 millisecond interval of a legato pulse, indicating the depression of a key on the upper manual keyboard. As long as line 48*a* is high, the lower switch in noise gate 44 is closed coupling the −14 volts on line 46 to lines 47, 55, and 49, holding the noise chopper 41 gate on and grounding line 39. Therefore, no signal can proceed past line 39 in the system unless both the enable switch 50 is closed and a low-going legato pulse is present on line 48*a* to noise gate 44.

In the presence of a legato pulse, with switch 50 closed, the output on line 45 from white noise source 42 assumes control of line 49. During the legato interval, noise chopper 41 is activated by the output from the digital noise source 42, which is a pseudorandom sequence generator used to generate white noise. This white noise generator might be, for example, an MM 5837 supplied by National Semiconductor. The 5837 is a digital noise source including a pseudo-random sequence generator. The signal from capacitor 37 (FIG. 2(*b*)) is coupled through resistor 38 to line 39, which is chopped by the white noise input on line 49. Due to the low 6.8 hz repetition rate of the triangular wave signal, its amplitude is relatively constant over the brief approximately 2 millisecond legato interval. It is this amplitude level which is chopped by the white noise source output and connected on line 43 to noise gate 44.

During the interval of the legato pulse, the upper switch in noise gate 44, which had been closed, is now open and coupling the output of noise chopper 41 on lines 39, 43 and 51 through capacitor 52 to the audio output stages. The output signal, then, is an approximately 2 milliseconds long interval of white noise whose amplitude is determined by the randomly selected level on line 39 at the time of the legato pulse. Digital implementation of the above circuits provides an advantage over analog approaches in stable and repeatable performance.

What is claimed is:

1. A special effects circuit for use in a d.c. keyed electronic keyboard instrument providing an output signal which simulates the transient signal generated by contact closure in an a.c. keyed electronic keyboard instrument comprising:

waveform generator means for receiving an adjustable level d.c. voltage signal and for providing a low frequency output signal with a peak voltage level related to the level of said d.c. signal;

source means for providing a white noise signal;

noise gating means for receiving said low frequency output signal and said white noise signal and providing an amplitude modulated noise signal output having an amplitude continuously varying in relation to said low frequency output signal;

control means enabled by a short duration pulse indicating that a key is depressed and receiving said amplitude modulated noise output signal for providing a simulated a.c. transient output signal having a duration corresponding to said pulse and an amplitude related to the amplitude of said low frequency signal during the duration of said pulse.

2. A special effects circuit as set forth in claim 1 further comprising:

signal generator means for providing a control signal having an adjustable duty cycle;

said adjustable duty cycle control signal connected to said waveform generator for influencing the peak voltage level of said low frequency output signal.

3. A special effects circuit as set forth in claim 2 where in said waveform generator comprises:

a chopper circuit receiving said adjustable duty cycle signal at one terminal and said d.c. level signal connected to another terminal;

a filter circuit for receiving said d.c. level signal and providing said low frequency output signal having an amplitude equal to the percentage of the duty cycle of said duty cycle signal multiplied by the amplitude of said d.c. level signal.

4. In a d.c. keyed electronic keyboard instrument a plurality of special effects circuits each providing an output signal which simulates the transient signal generated by contact closure in an a.c. keyed electronic keyboard instrument wherein each special effects circuit comprises:

waveform generator means for receiving an adjustable level d.c. voltage signal and for providing a low frequency output signal with a peak voltage level related to the level of said d.c. signal;

source means for providing a white noise signal;

noise gating means for receiving said low frequency output signal and said white noise signal and providing an amplitude modulated noise signal output having an amplitude continuously varying in relation to said low frequency output signal;

control means enabled by a short duration pulse indicating that a key is depressed and receiving said amplitude modulated noise output signal for providing a simulated a.c. transient output signal having a duration corresponding to said pulse and an amplitude related to the amplitude of said low frequency signal during the duration of said pulse; and, a signal generator means for providing a control signal having an adjustable duty cycle;

said adjustable duty cycle control signal being connected to said waveform generator of each of said special effects circuit thereby providing a common amplitude control signal for each special effects circuit.

* * * * *